United States Patent [19]

West

[11] 4,121,671

[45] Oct. 24, 1978

[54] PILE DRIVING

[76] Inventor: Joe Edward West, 11426 Goodnight La., Dallas, Tex. 75229

[21] Appl. No.: 795,489

[22] Filed: May 10, 1977

[51] Int. Cl.[2] ..... B25D 9/00

[52] U.S. Cl. ..... 173/131; 173/103; 173/139

[58] Field of Search ..... 173/131, 139, 101, 102, 173/103, 128, 133, 116

[56] References Cited

U.S. PATENT DOCUMENTS

| | | | |
|---|---|---|---|
| 3,205,790 | 9/1965 | Bollar | 173/116 |
| 3,498,391 | 3/1970 | Guild et al. | 173/131 |
| 3,797,585 | 3/1974 | Ludvigson | 173/131 |

*Primary Examiner*—Robert A. Hafer

*Attorney, Agent, or Firm*—Joseph H. Schley; Thomas L. Cantrell

[57] ABSTRACT

Disclosed is an apparatus for increasing the effectiveness of hammer-type pile drivers by making possible the use of higher hammer velocities without damaging the pile or the equipment. The apparatus includes a pair of aligned cylinders of unequal diameter, the smaller of which contains an anvil piston and the larger of which contains a driving piston, connected to a pile cap engageable with a pile. Means are provided for applying a deadweight load to the apparatus and for maintaining the space lying between the pistons full of liquid. In addition to enabling use of higher hammer velocities, the apparatus effectively incorporates the deadweight load into driving force when the hammer strikes.

8 Claims, 1 Drawing Figure

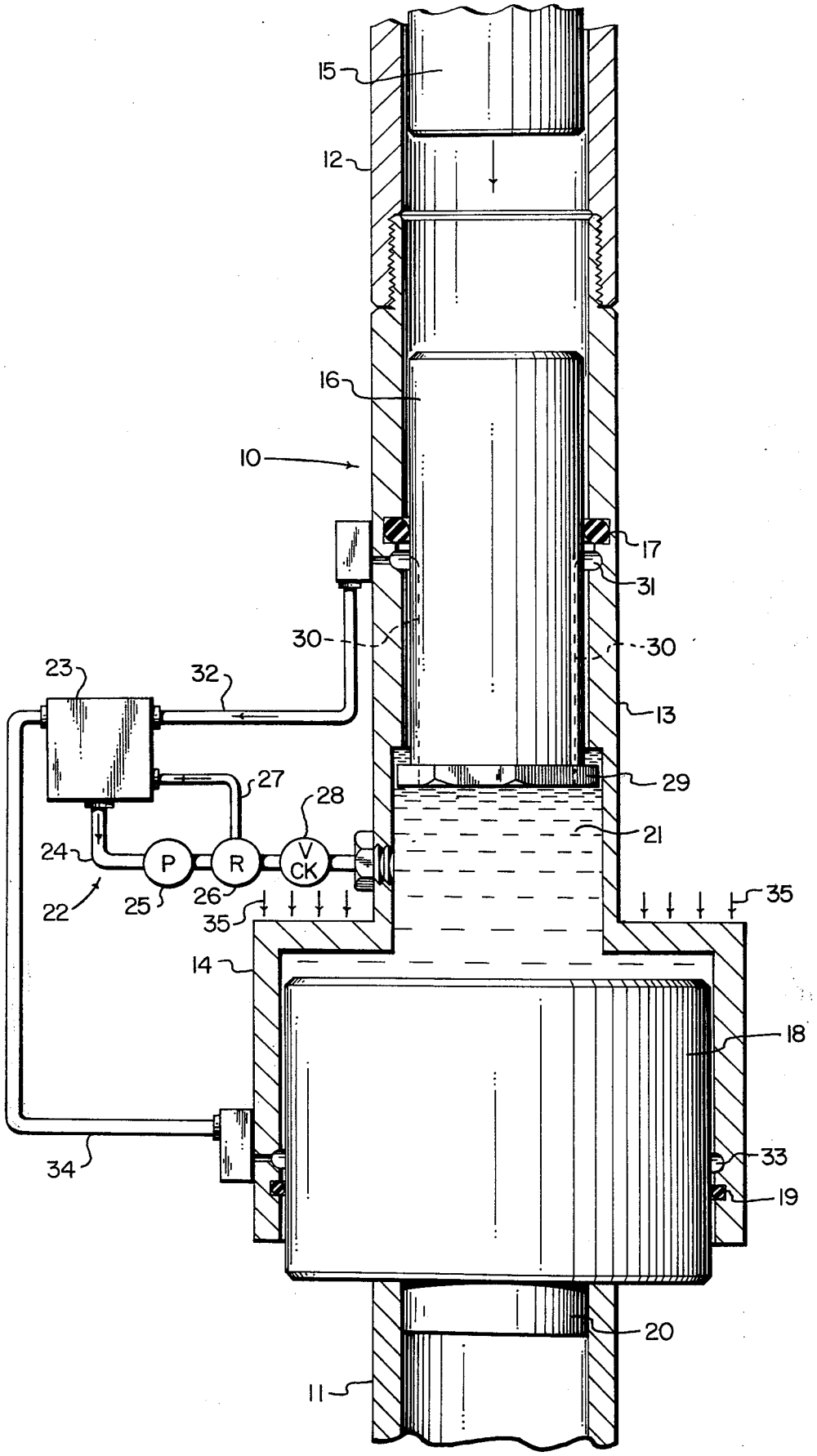
15
12
16
10
17
31
30
30
23
32
13
27
28
29
21
24
P
R
V
CK
22
25
26
35
35
14
18
34
33
19
20
11

PILE DRIVING

BACKGROUND OF THE INVENTION

In hammer-type pile drivers, the driving force on the pile is derived from the mass of the hammer and the hammer velocity at impact. In any given pile driving operation, the mass of the hammer is fixed, and is usually relatively small for the sake of convenience. Thus, hammer velocity is the primary variable parameter for altering the force applied to the pile. Because there is a limit upon the ability of a pile to accelerate upon acceptance of a blow from a hammer, there is also a practical upper limit in any given situation on the impact velocity of the hammer. If this upper limit is exceeded, the pile will be deformed or damaged by the hammer blow, since it is unable to accelerate out of the way of the hammer rapidly enough. There thus results a practical limit on the driving force available per hammer blow, and on the capacity of the unit.

Most pile driving equipment involves, in addition to the moving hammer, considerable additional structure having, in the aggregate, an appreciable mass. But in conventional pile driver arrangements, this mass is left unexploited as a source of direct pile driving force.

SUMMARY OF THE INVENTION

In accordance with the invention, apparatus is provided which in any given pile driving situation increases the upper limit of hammer impact velocity and hence the driving force per blow, while at the same time making possible the use of the mass of the pile driver structure, or part of it, or specially provided deadweights, as a source of direct pile driving force.

In its preferred form, the invention includes a pair of axially aligned cylinders of different diameters which are alignable with the path of travel of the pile driving hammer and with the pile to be driven. The internal volumes of the cylinders are in communication with each other. The smaller diameter cylinder is oriented toward the hammer, normally upwardly, and the larger cylinder is oriented toward the pile, normally downwardly.

An anvil piston is mounted for reciprocation in the smaller cylinder in position to be struck by the pile driving hammer.

In the larger cylinder, a driving piston is mounted for reciprocation. Attached to its outer or lower end is a pile driving cap, which may take various forms, depending upon the particular type of piling with which it is to be engaged.

The equipment of the invention also includes means for applying a deadweight load to urge the larger cylinder toward the pile. This load may comprise part, or even all, of the static structural equipment of the pile driver, or it may comprise specially provided loading weights, in sizes and numbers adequate to supply a mass appropriate for a particular job. If desired, the deadweight load may be supplied partly by the pile driver structure, and partly by specially provided weights.

Means are also provided for maintaining the volume in said cylinders which lies betweeen the two pistons filled with liquid at all times: during administration of a hammer-blow; while the equipment is settling to the new pile position after a blow; and while the equipment is at repose in anticipation of a succeeding hammer-blow.

In the preferred form of the apparatus, the liquid maintenance means includes seals between each of the pistons and its respective cylinder for confining, or at least greatly retarding escape of, liquid from the apparatus during the course of a hammer-blow. The liquid maintenance means also preferably comprises a constant pressure liquid delivery pump, a check valve interposed between the pump and the liquid space, a liquid reservoir, a recycle line and valve, and cylinder pressure relief means. The pump and check valve serve to supply make-up liquid to the liquid space during the time intervals between hammer-blows, to replace that which has escaped from the liquid space through the pressure relief means or through the seals.

In operation, the pile driver hammer is impelled toward the upper face of the anvil piston by conventional means. It strikes the anvil piston and the anvil piston moves downwardly in its cylinder in response to the blow. This downward movement causes a downward movement of shorter stroke by the driving piston in its cylinder, and the pile is accordingly started in motion downwardly through the strata into which it is being driven.

The foregoing action is accompanied by a steep pressure rise in the liquid confined in the cylinders. Part of this pressure is expended in an effort to lift the lower cylinder and whatever deadweight it is carrying off of the driving piston and the pile. This effort is resisted by the deadweight, which, by reaction through the liquid, is applied to the face of the driving piston to become a component of the driving force applied to the moving pile.

When friction between the pile and the strata brings the pile to rest, the return of make-up liquid to the liquid space replaces whatever has been vented through the pressure relief means or lost past the seals, restores the liquid volume and pressure to the desired starting values, and also restores the two pistons to their desired starting positions in readiness for the next hammer-blow.

Higher hammer velocities are thus made possible because the movement of the pile required to accommodate total stoppage of hammer movement within a given time is reduced to a level which will prevent pile damage because it is within the acceleration capability of the pile. Higher hammer velocity results in greater driving force attributable to the hammer alone. Beyond this, the pile is subjected to the bonus driving force attributable to the deadweight which, in accordance with the invention, is dynamically applied to the pile during a hammer-blow.

If desired, instead of obtaining higher driving forces through higher impact velocity for a hammer of given mass, one may reduce the mass of the hammer while increasing its velocity to obtain the same driving force with a lighter hammer.

From the foregoing, it can be seen that the principal object of the invention is the provision of an apparatus for improving pile driving by increasing the driving force which can be applied to a pile without damaging it, by increasing hammer velocity and by exploiting deadweight to obtain driving force.

The manner in which this and other objects of the invention are obtained may best be understood by a consideration of the detailed description which follows, together with the accompanying drawing.

DESCRIPTION OF THE DRAWING

The single FIGURE of the drawing shows in somewhat diagrammatic sectional elevation an apparatus for improving pile driving constructed in accordance with the invention.

DESCRIPTION OF THE PREFERRED EMBODIMENT

In the drawing, the apparatus of the invention is designated generally as 10. It is interposed between a pile to be driven 11, shown as a hollow cylindrical pile, and the remainder of the structural equipment of a pile driver, represented diagrammatically in the drawing by hammer guide tube 12.

The force transmission apparatus 10 includes a pair of axially aligned cylinders 13, 14 which are of different diameters. The interiors of the cylinders are in communication with each other, preferably with no obstructions interposed to impede liquid flow between cylinders. Cylinders 13, 14, in addition to being axially aligned, are alignable with the pile to be driven 11, and with the path of travel of pile driving hammer 15.

Cylinder 13 is of selected diameter smaller than that of cylinder 14. Cylinder 13 is oriented toward the balance of the pile driver, or generally upwardly, and has anvil piston 16 mounted for reciprocation therein. A liquid seal 17 is provided in the wall of cylinder 13 between it and the surface of anvil piston 16.

Larger cylinder 14 is oriented toward pile 11, or generally downwardly, and has driving piston 18 mounted for reciprocation therein. A liquid seal 19 is provided in the wall of cylinder 14 between it and the surface of driving piston 18.

Pile cap 20 is mounted on the outer or lower face of driving piston 18 and is engageable with pile 11. Cap 20 may take various forms, and may be altered in shape to cooperate with various types of piles.

In accordance with the invention, the internal volume of cylinders 13, 14 between pistons is filled with a liquid 21. Since, in the course of operation, liquid may be blown out of cylinders 13, 14 past seals 17, 19, it is preferred that liquid 21 be water, hydraulic fluid, or another inexpensive material.

In order to confine liquid 21 within the space between pistons 16 and 18 during operations, to restore any liquid which may be lost during operations, and to reposition the pistons between blows, a liquid maintenance system designated generally as 22 is provided. It includes a liquid reservoir 23, and a line 24 connecting the reservoir to the liquid space between the pistons. In line are mounted constant pressure pump 25, a recycle valve 26 (together with recycle line 27 back to the reservoir), and check valve 28.

Anvil piston 16 has a polygonal cap 29 at its inner end, and longitudinal grooves 30 in its surface. Cap 29 provides an ultimate restraint against upward movement of piston 16, and, by reason of its polygonal shape admits liquid 21 to grooves 30.

Cylinder 13 is provided with an annular internal groove 31 just below seal 17. Groove 31 is connected to pressure relief line 32, which returns to the reservoir. Similarily, cylinder 14 is provided with an annular groove 33, just above seal 19, which is connected to a second pressure relief line 34 returning to the reservoir.

Provision is made, in accordance with the invention, to apply a deadweight to cylinder 14 to urge it toward pile 11. This deadweight may be part or all of the pile driver structure, as represented by guide tube 12 in the drawing, or it may include specially added weights, represented diagrammatically by the heavy downwardly oriented arrows 35 in the drawing.

In operation, hammer 15 is driven toward anvil piston 16 in any conventional manner. When piston 16 is struck, it moves downwardly in cylinder 13. Because liquid 21 is essentially incompressible, driving piston 18 also moves downwardly in cylinder 14 against pile 11, starting it in motion downwardly. Piston 18 moves a smaller distance in cylinder 14 than does piston 16 in cylinder 13 as a consequence of the larger diameter of cylinder 14, during the time between impact of hammer 15 and cessation of downward movement of the pistons in the cylinders.

The steep rise in pressure in liquid 21 upon hammer impact results in upward forces against deadweights 12, 35, which by reaction are applied downwardly against piston 18 and thus to pile 11, which sees the deadweight as additional dynamic driving force.

During the impact, the steep rise in pressure in the liquid between the pistons closes check valve 28, thus protecting pump 25 and reservoir 23. Recycle valve 26 opens and liquid pumped by the pump returns through recycle line 27 to the reservoir. When the liquid pressure between the pistons rises abruptly during impact, some liquid will be forced between pistons 16 and 18 and the walls of their respective cyclinders 13 and 14. Little or none of this liquid is blown out of the unit, however, because it is directed through pressure relief grooves 31, 33 and pressure relief lines 32, 34 back to the reservoir 23.

At the completion of a stroke, pump 25 returns liquid to the space between the pistons. Cylinder 14 settles downwardly on piston 18 and pile 11, and piston 16 moves upwardly in cylinder 13 until grooves 30 come into communication with groove 31. At this point, the liquid volume and pressure are at the desired values and the pistons are properly positioned with respect to the cylinders for the reception and transmission of another hammer-blow.

From the foregoing it can be seen that the apparatus of the invention simultaneously increases driving force, protects the pile, and permits increased velocity and reduced hammer mass, if desired.

I claim:

1. Apparatus for increasing the effectiveness of a hammer-type pile driver comprising:

a first cylinder of selected diameter alignable with a pile to be driven and with the path of travel of a pile driving hammer;

a second cylinder of selected diameter larger than that of said first cylinder, said cylinders being axially aligned and in communication with each other;

an anvil piston mounted for reciprocation in said first cylinder in position to be struck by the hammer of said pile driver;

a driving piston mounted for reciprocation in said second cylinder;

a pile cap connected to said driving piston and engageable with a pile to be driven;

means for applying a selected deadweight load for urging said second cylinder toward said pile to be driven;

and means for maintaining the volume in said cylinders lying between said pistons filled with liquid.

2. Apparatus in accordance with claim 1 in which said means for maintaining liquid volume in said cylinders comprises a liquid reservoir, a line connecting said reservoir to the space in said cylinders between said pistons, a pump in said line, and a check valve in said line between said pump and said space.

3. Apparatus in accordance with claim 2 and further comprising means for collecting liquid driven between said anvil piston and the wall of said first cylinder upon impact of said hammer with said anvil piston and for returning said liquid to said reservoir.

4. Apparatus in accordance with claim 2 and further comprising means for collecting liquid driven between said driving piston and the wall of said second cylinder upon impact of said hammer with said anvil piston, and for returning said liquid to said reservoir.

5. Apparatus in accordance with claim 2 and further comprising a recycle valve positioned in said line between said pump and said checkvalve, and openable upon closure of said check valve, and a recycle line connected between said recycle valve and said reservoir for recycling liquid from said pump to said reservoir.

6. Apparatus in accordance with claim 1 in which said means for maintaining liquid volume in said cylinders comprises sealing means between said cylinders and their respective pistons.

7. Apparatus in accordance with claim 1 in which at least part of said deadweight load comprises at least part of the weight of said pile driver.

8. Apparatus in accordance with claim 1 in which at least part of said deadweight load is weights separate from said pile driver.

* * * * *